US006216658B1

(12) United States Patent
Pierro et al.

(10) Patent No.: US 6,216,658 B1
(45) Date of Patent: Apr. 17, 2001

(54) ENGINE CYLINDER BLOCK WITH OPTIMIZED STIFFNESS

(75) Inventors: Enzo Pierro, Drayton Near Abingdon; Nikos Jon Chimonides, Maidenhead, both of (GB); Hermann-Josef Huestegge; Phil Scarth, both of Steinebrunn (CH); Craig James Korte, Columbus, IN (US); Andrew Clamp, Co Durham (GB); Jean-Patrick Vernon Rich, London (GB); Hans-Jurg Nydegger, High Wycombe (GB)

(73) Assignees: Cummins Engine Company Ltd., Darlington; Iveco (UK) Ltd., Watford; New Holland U.K. Ltd., Basildon, all of (GB)

( * ) Notice: Subject to any disclaimer, the term of this patent is extended or adjusted under 35 U.S.C. 154(b) by 0 days.

(21) Appl. No.: 09/336,105

(22) Filed: Jun. 18, 1999

(30) Foreign Application Priority Data

Jun. 19, 1998 (GB) ..... 9813274

(51) Int. Cl.[7] ..... F02F 7/00

(52) U.S. Cl. ..... 123/193.2; 123/41.74

(58) Field of Search ..... 123/193.2, 193.3, 123/193.5, 41.33, 41.74, 195 R, 196 AB

(56) References Cited

U.S. PATENT DOCUMENTS

| | | | | |
|---|---|---|---|---|
| 2,126,089 | * | 8/1938 | Brown | 123/193.2 |
| 2,208,705 | | 7/1940 | DeLong et al. . | |
| 3,693,602 | | 9/1972 | Thien et al. . | |
| 4,142,502 | | 3/1979 | Nakano et al. . | |
| 4,175,503 | * | 11/1979 | Ernest | 123/193.3 |
| 4,237,847 | | 12/1980 | Baugh et al. . | |
| 4,329,947 | | 5/1982 | Ishihara . | |
| 4,438,733 | | 3/1984 | Sasaki . | |
| 4,461,247 | | 7/1984 | Hayashi . | |
| 4,470,376 | | 9/1984 | Hayashi . | |
| 4,520,768 | * | 6/1985 | Shimonosono et al. | 123/41.74 |

(List continued on next page.)

FOREIGN PATENT DOCUMENTS

| | | |
|---|---|---|
| 1040726 | 10/1953 | (FR) . |
| 949762 | 4/1962 | (GB) . |
| 2168430 | 6/1986 | (GB) . |
| 5-321667 | 12/1993 | (JP) . |

OTHER PUBLICATIONS

Howrath, M.H., The Design of High Speed Diesel Engines, Constable, p. 146 (1966).

* cited by examiner

*Primary Examiner*—Marguerite McMahon
(74) *Attorney, Agent, or Firm*—Leydig, Voit & Mayer, Ltd.

(57) ABSTRACT

An integral cylinder block is provided having features which enhance structural stiffness, thereby reducing noise emissions. The block includes an upper portion with cylinder bores and a lower portion forming at least a part of a crankcase. At the upper and lower portions of the block, the casing has sculpted wall portions with a curved, undulate shape. At a side of the cylinder block, a closed oil cooler cavity is formed. A wall is provided to generally separate the oil cooler cavity from the water jacket defined within the block. An opening is provided in the wall, but the opening is distally located relative to a water pump outlet that provides a flow of coolant into the cavity, thereby improving the flow direction of coolant across the oil cooler. Also, an opposite side of the cylinder block includes a closed tappet cavity to accommodate pushrods. The closed tappet cavity is defined by a sculpted tappet cavity wall that is integrally formed with the upper and lower portions of the block, improving block rigidity.

15 Claims, 8 Drawing Sheets

U.S. PATENT DOCUMENTS

| | | | | |
|---|---|---|---|---|
| 4,627,394 | | 12/1986 | Asanomi et al. . | |
| 4,777,912 | * | 10/1988 | Fischer et al. | 123/41.74 |
| 4,846,116 | * | 7/1989 | Sakurahara et al. | 123/41.74 |
| 4,890,583 | | 1/1990 | Ohno et al. . | |
| 4,903,646 | | 2/1990 | Minagawa et al. . | |
| 5,016,584 | | 5/1991 | Inoue et al. . | |
| 5,058,542 | | 10/1991 | Grayson et al. . | |
| 5,083,537 | | 1/1992 | Onofrio et al. . | |
| 5,131,357 | | 7/1992 | Inoue et al. . | |
| 5,445,210 | | 8/1995 | Brassell . | |
| 5,474,040 | | 12/1995 | Murakami et al. . | |
| 5,477,817 | | 12/1995 | Hufendiek et al. . | |
| 5,558,048 | * | 9/1996 | Suzuki et al. | 123/41.74 |
| 5,758,608 | | 6/1998 | Berger et al. . | |

ENGINE CYLINDER BLOCK WITH OPTIMIZED STIFFNESS

BACKGROUND OF THE INVENTION

The present invention generally relates to a cylinder block for an internal combustion engine and more particularly relates to a cylinder block with enhanced structural stiffness.

Deflection of a cylinder block of an engine is generally undesirable. Such deflection contributes to undesirable vibrational modes and noise emission levels when an assembled engine is running. It is known to provide stiffened block components in order to generally reduce the level of noise emitted from a running engine. For example, stiffened cylinder block walls are disclosed in U.S. Pat. Nos. 4,470,376; 4,461,247; and 4,627,394.

Block deflection can also lead to manufacturing complications. A conventional cylinder block substantially deflects between a free condition and an assembled condition due to the loads and stresses from cylinder head bolts and other components. Such distortion leads to an improper fit of components and unwanted tolerance changes. Accordingly, simulated loads are applied to conventional cylinder blocks during machining operations. An example of such a process is known as torque plate honing, whereby a torque plate is bolted to the conventional block to approximate the loads of a bolted-on cylinder head during honing of the cylinder bores. The bores are thus round when the cylinder head is later mounted to the block. Torque plate honing is necessitated by the degree of deflection of a conventional block. Otherwise, if the cylinder bores were machined while the block was in an unloaded condition, the cylinder bores would deflect from a round shape when the block is in its loaded, assembled condition, resulting in imprecise tolerances, undesirable wear patterns and poor oil consumption. Unfortunately, torque plate honing is costly and difficult to control in a production environment.

Conventional cylinder blocks have various openings formed therein to permit the connection of conduits, hoses, and other components. For example, an opening is conventionally formed in the wall of a cylinder block to accommodate the mounting of an oil cooler in fluid communication with the water jacket. A lack of structural material in such an opening leads to undesirable flexibility of the block. Accordingly, a need exists to design such a cavity with improved stiffness.

Another component known to emit noise is a cover plate that is bolted to a side of the cylinder block to cover reciprocating pushrods that extend from the crankcase to the cylinder head. The cover plate is known to transmit substantial levels of noise.

Accordingly, design features are desirable which provide a stiff block structure in order to reduce noise emission levels and to reduce deflection between free and assembly-loaded conditions.

SUMMARY OF THE INVENTION

According to the invention, a cylinder block is provided with enhanced stiffness. The cylinder block has an upper portion with a plurality of cylinder bores and a lower portion which forms a portion of the crankcase. Both the upper and lower portions of the block include sculpted outer wall portions. More specifically, the sculpted outer wall portions include a series of curved, non-planar sections. Each section is shaped generally as a partial cylinder so that the sculpted portion has an undulate shape. It has been found that the curved non-planar sections provide substantially greater stiffness relative to conventional planar wall sections.

An embodiment of the block may include stiffening ribs which extend between the cylinder bore and the outer wall of the block. The ribs are positioned to optimize cylinder bore stiffness. Bolt bosses may be integrally formed in the ribs having bolt holes to accommodate mounting of the cylinder head.

In an embodiment, the cylinder block includes an enclosed closed oil cooler cavity having a wall extending between the cavity and the water jacket. This wall provides structural rigidity to the cavity area, enhancing the stiffness of the block.

The cavity wall has an opening, which permits fluid communication between the cavity and the water jacket. A water pump outlet provides a flow of coolant into the cavity; however, the cavity wall opening is distally located relative to the water pump outlet so that coolant is advantageously guided to flow across the oil cooler with enhanced effectiveness.

In an embodiment, the block includes a closed tappet cavity, further enhancing stiffness of the block. More specifically, the tappet cavity has an upper wall that extends across the deck of the block. Holes are provided in the upper wall to permit pushrods to protrude upwardly to the cylinder head. The upper wall closing the tappet cavity provides additional stiffness to the block.

An advantage of the present invention is to provide a cylinder block with enhanced stiffness.

Another advantage of the present invention is to provide a cylinder block that reduces engine noise.

A further advantage of the present invention is to provide a cylinder block that eliminates a need for a torque plate honing process.

Yet another advantage of the present invention is to provide a cylinder block that reduces oil consumption.

A still further advantage of the present invention is to provide a cylinder block that enhances oil-cooling efficiency.

Additional features and advantages of the invention are described in, and will be apparent from, the Figures, description, and claims herein.

DETAILED DESCRIPTION OF THE DRAWINGS

Figure 1:
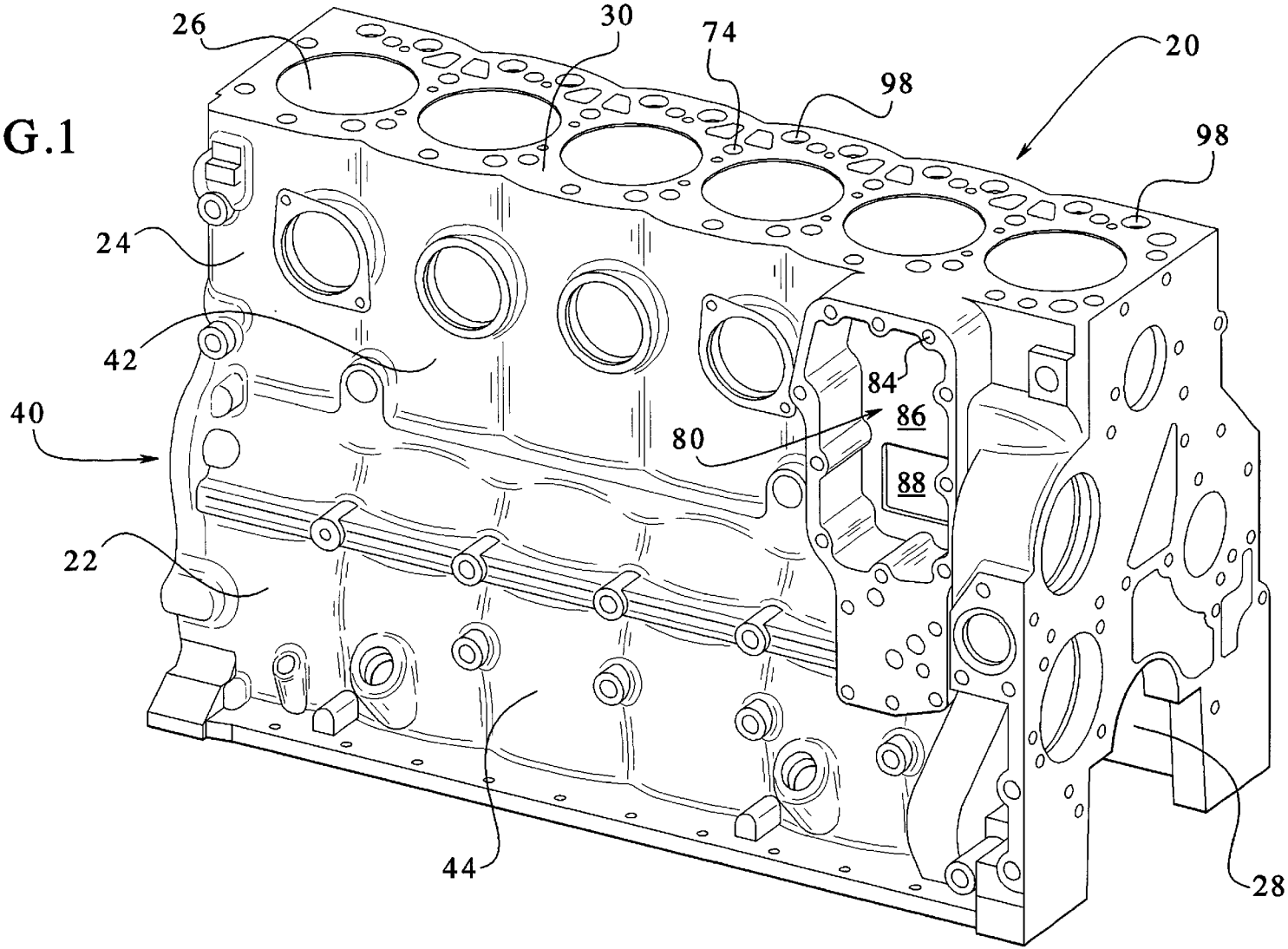
FIG. 1 is a perspective view of a cylinder block embodying features according to the present invention.

Now referring to the Figures, wherein like numerals designate like parts, FIGS. 1–6 illustrate a cylinder block 20 according to an embodiment of the invention. As illustrated in FIG. 1, the cylinder block 20 has an integrally formed metal body, including a lower portion 22 and an upper portion 24. The block 20 has an outer casing 40 which is shared by the upper and lower portions 22 and 24. A plurality of cylindrical parent bores 26 are formed in the block 20 to accommodate reciprocating pistons (not shown). An inner surface of each of the cylinder bores 26 is precisely machined to a smooth finish. The lower portion 22 forms a portion of a crankcase 28. An oil pan (not shown) is typically mounted to the lower portion of the block 20 to enclose the crankcase.

The upper portion 24 of the block 20 forms a deck 30 on which a cylinder head (not shown) is to be mounted. As illustrated, the block 20 is of an in-line six-cylinder configuration, although the features of the invention may be applied to a block having another cylinder configuration as well.

The cylinder block 20 includes structural features according to the invention which enhance stiffness and which result in reduced noise emission levels by reducing block deflection. The stiffened block 20 also results in increased manufacturing efficiency and improved oil-cooling performance.

According to the invention, to provide improved stiffness, the outer casing 40 of the cylinder block 20 includes curved or sculpted wall portions 42, 44 at the lower crankcase portion 22 and at the upper portion 24, respectively, as illustrated in FIG. 1. More specifically, each of the sculpted wall portions 42, 44 of the block 20 includes a series of undulate, non-planar wall sections 46, 48, respectively. Preferably, each wall section 46, 48 is curved, shaped as a partial cylinder, or otherwise non-planar. In an embodiment having cylindrical wall sections 46 and/or 48, the sections 46, 48 may be located coaxially relative to the cylinder bores 26. It has been found that the non-planar wall sections 46, 48 provide substantially greater stiffness relative to conventional planar wall sections without adding weight.

Figure 2:
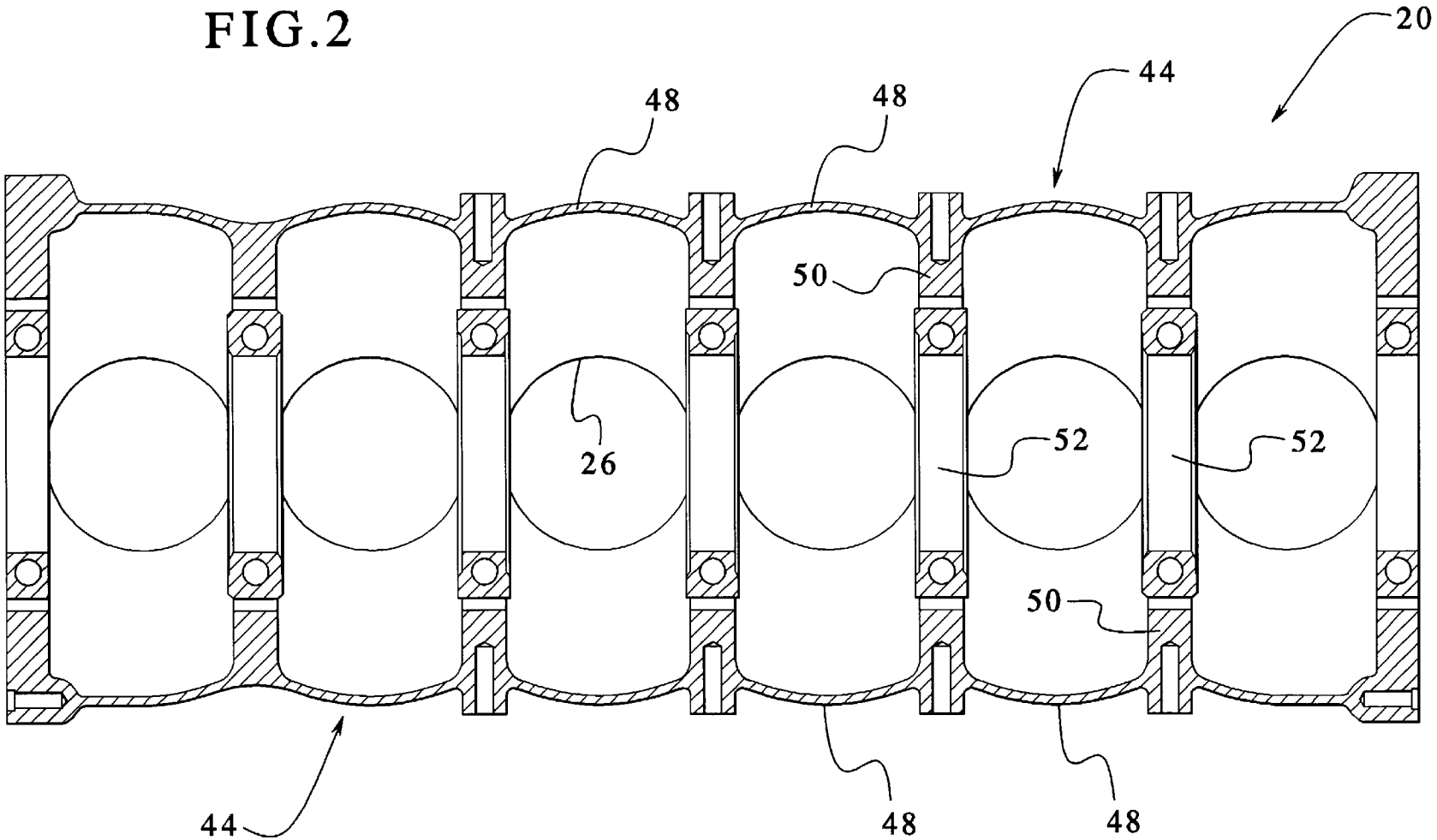
FIG. 2 is a sectional view as taken generally along line 11—11 of FIG. 5 illustrating curved wall portions in the vicinity of the lower portion of the cylinder block.

Referring particularly to FIG. 2, the lower sculpted wall portion 44 of the block 20 is shown. The non-planar wall sections 48 are concave inwardly relative to the crankcase 28. Transverse support members 50 extend across the interior of the crankcase 28, and each of the sections 48 extends between a neighboring pair of the support members 50. A crank bearing surface 52 is centrally formed in each of the support members 50.

Figure 3:
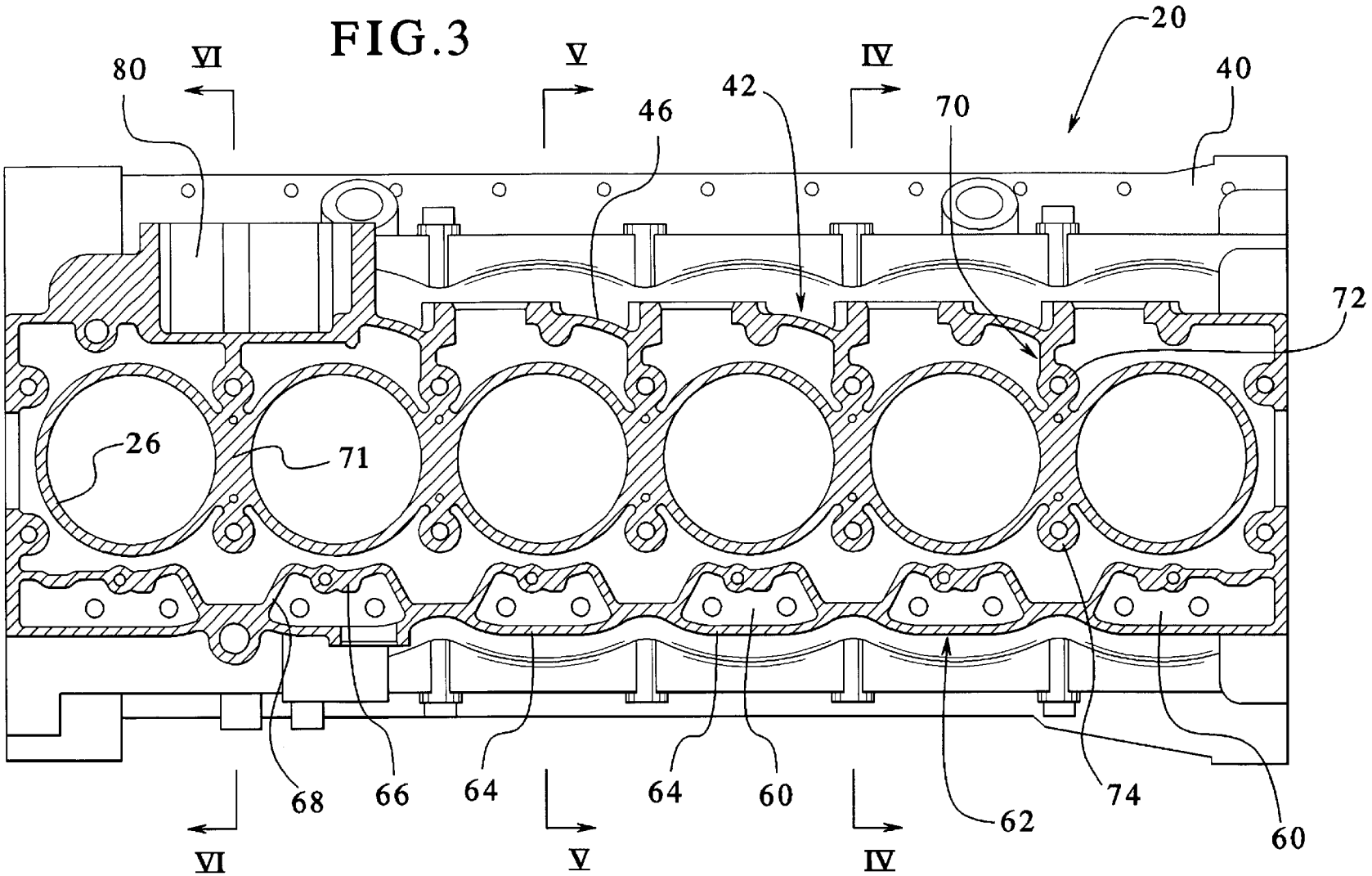
FIG. 3 is a sectional view as taken generally along line III—III of FIG. 5 illustrating curved wall portions in the vicinity of the upper portion of the cylinder block.

Turning to FIG. 3, the non-planar wall sections 46 of the upper sculpted wall portion 42 are illustrated. On a side of the block 20 opposite the sculpted wall portion 42, the casing 40 includes a sculpted closed tappet wall 62. The closed tappet wall 62 is undulate in shape for enhanced stiffness and encloses a plurality of tappet cavities 60 as described in greater detail below in connection with FIG. 5. Each of the tappet cavities 60 is generally formed by a tubular member having a curved, non-planar inner wall 66 and a curved, non-planar outer wall section 64 of the sculpted closed tappet wall 62. Shorter sides 68 integrally connect the inner wall 66 and outer wall section 64. The outer wall sections 64 and the inner walls 66 are concave in a direction generally facing the cylinder bores 26.

Figure 4:
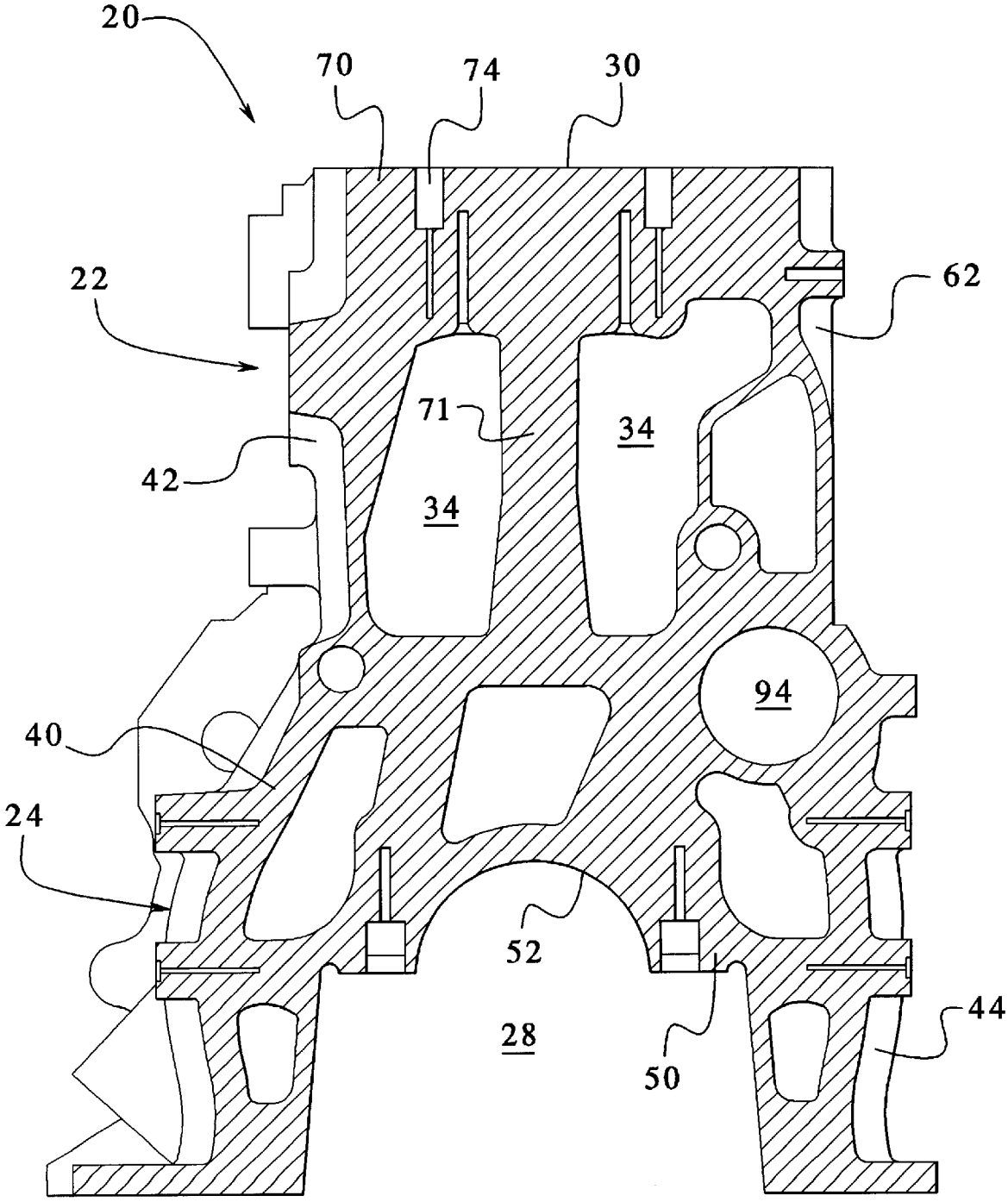
FIG. 4 is a sectional view as taken generally along line IV—IV of FIG. 3 illustrating one of the reinforcing ribs extending between a respective cylinder bore and the outer wall.

For further enhancing stiffness of the cylinder bores 26, the upper portion 24 of the block 20 may include a plurality of stiffening ribs 70 as shown in FIGS. 3 and 4. Each of the ribs 70 extends between the cylinder bores 26 and a cylinder head bolt boss 72. More particularly, in the illustrated embodiment, the ribs 70 are connected to a member 71 formed by material shared by adjacent cylinder bores 26. The ribs 70 also connect the bosses 72 to the sculpted wall portion 46. The ribs 70 are positioned to optimize stiffness of the cylinder bores 26 and to cause any distortion that does occur to be as cylindrical as possible.

Additionally, each of the cylinder head bolt bosses 72 has a bolt hole 74 with threads that extend a greater distance into the block 20 than conventional bolt holes. Providing such lowered threads has been found to result in an improved load distribution in the block 20, reducing an amount of contact pressure variation on the gasket ring (not shown) around each of the cylinder bores 26. Specifically, the deep-positioned threads of the invention result in a pressure ratio variation (the ratio between the maximum pressure and minimum pressure) of about 1.6 as compared to a pressure ratio variation of about 3.4 for a conventional block.

Figure 6:
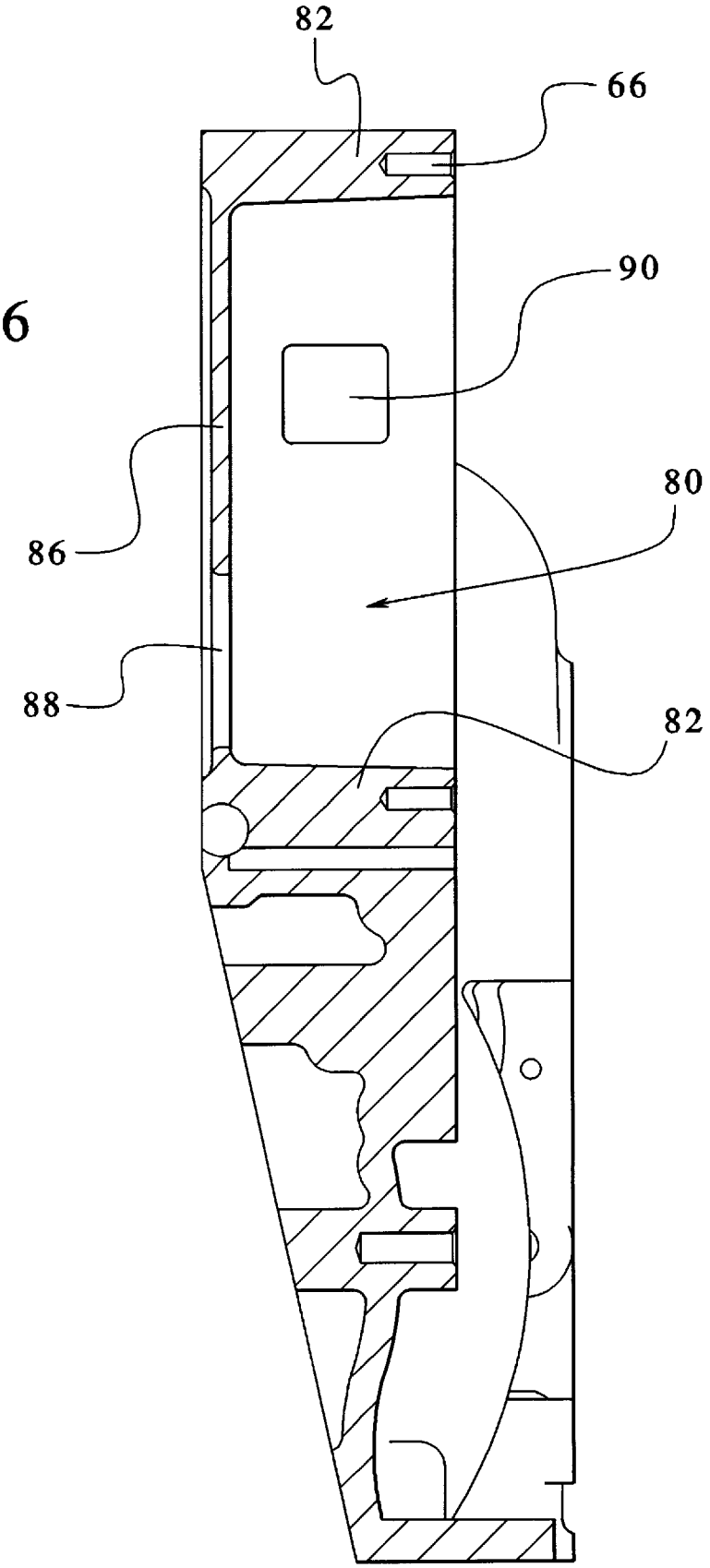
FIG. 6 is a fragmentary sectional view of a cylinder block of FIG. 3 as taken X generally along line VI—VI, illustrating an embodiment having a closed oil cooler cavity.

As illustrated in FIGS. 1, 3 and 6, an oil cooler cavity 80 is formed in a side of the cylinder block 20. The oil cooler cavity 80 is shaped to receive a heat exchanger (not shown) for cooling engine oil. The oil cooler cavity 80 is provided with a flow of coolant, as described below in greater detail. The oil cooler cavity 80 is peripherally defined by four side walls 82 integrally formed as a side of the block 20, as illustrated. The side walls 82 include bolt bosses 84 with bolt holes to accommodate the securing of a cover plate (not shown) with treaded bolts.

Figure 5:
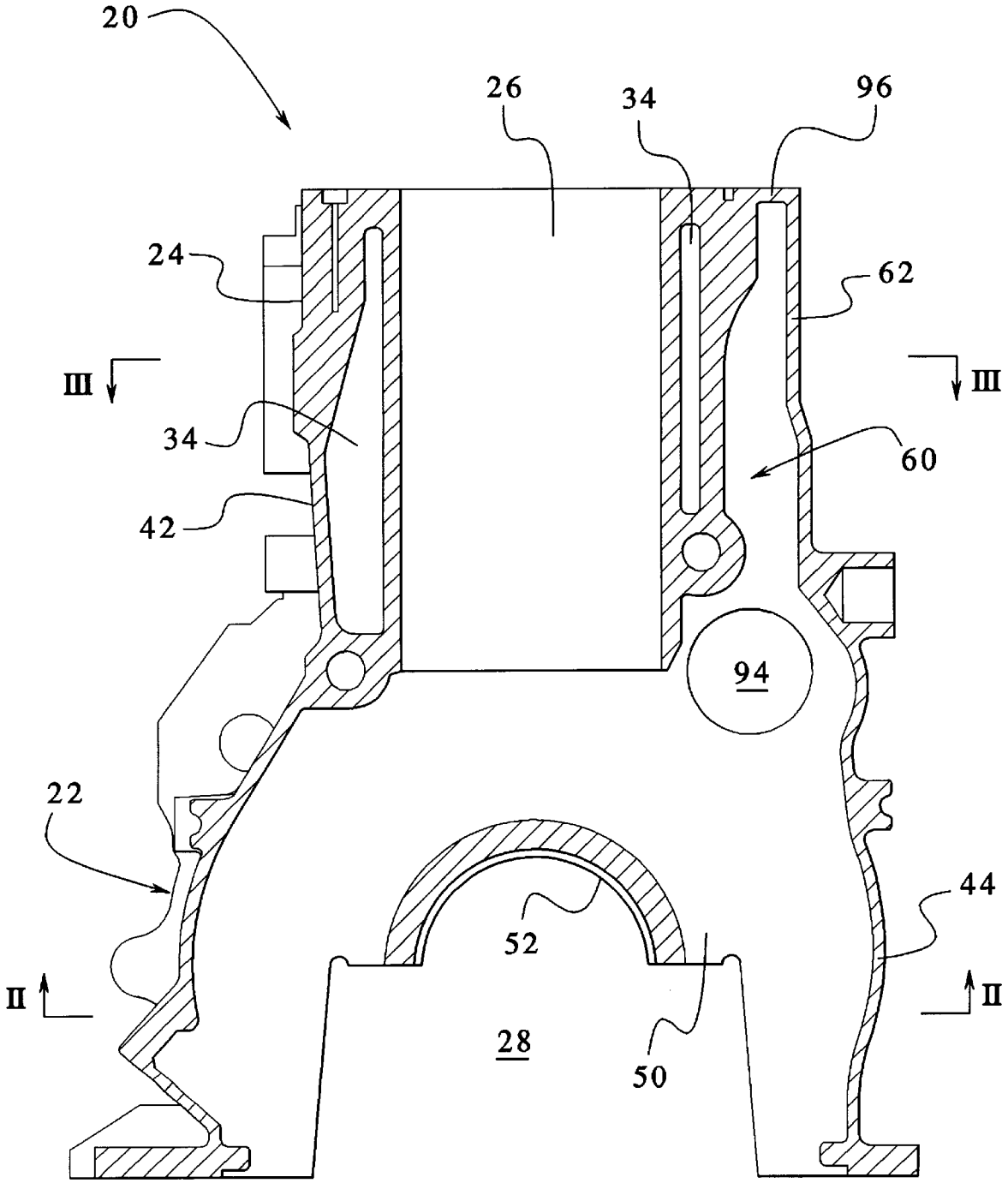
FIG. 5 is a sectional view as taken generally along line V—V of FIG. 3 illustrating a closed tappet area generally at the right.

The block 20 has a water jacket 34 providing a passage for a flow of coolant around the cylinder bores 26 (FIGS. 4, 5). A conventional oil cooler cavity has had an entire side that opens directly into the water jacket. According to an embodiment of the invention, however, for further enhancing stiffness, the oil cooler cavity 80 is substantially closed by a cavity wall 86 extending between the side walls 82, generally separating the cavity 80 from the water jacket. This cavity wall 86 provides structural rigidity to the region of the cavity 80, enhancing the overall stiffness of the block 20.

Advantageously, the cavity wall also enhances oil-cooling performance. Specifically, the cavity wall 86 has an opening 88 formed therein to permit fluid communication between the cavity 80 and the water jacket 34. A water pump outlet 90 (FIG. 6) opens into the cavity 80, delivering a flow of coolant from a water pump outlet duct across a core of the oil cooler. According to an embodiment of the invention, the opening 88 is distally located relative to the water pump outlet 90 so that coolant is advantageously guided to flow across a substantial area of the oil cooler to enhance cooling efficiency. As shown in FIG. 6, the water pump outlet 90 is generally at an upper portion of the cavity 80 while the opening 88 is located generally at a lower portion of the cavity 80. It has been found that the cavity wall 86 of the invention results in a 49% improvement in oil cooling efficiency compared to a conventional open oil cooler cavity.

FIG. 5 shows the closed tappet cavities 60 mentioned above in connection with FIG. 3. Each of the tappet areas 60 is enclosed at an outer side by the sculpted closed tappet wall 62 which is integrally cast with the block 20. In particular, the block 20 includes cam bores 94 formed in the transverse support members 50 positioned in the crankcase 28. A rotating cam shaft (not shown) is mounted in the cam bores 94, driving a plurality of pivotably-mounted cam followers which cause a plurality of respective pushrods to reciprocate in a generally known manner. The pushrods extend upwardly through the closed tappet cavity 60 and protrude from the block 20 through holes 98 (FIG. 1) to operate valves in the cylinder head.

As shown in FIG. 5, a top of each of the tappet cavities 60 is also closed by an upper tappet cavity wall 96 which is integrally formed with the cylinder head deck 30. In particular, the upper tappet cavity wall 96 extends across a top of the closed tappet cavity 60 between the pushrod holes 98 (FIG. 1) in the deck 30, integrally connecting to a top edge of the sculpted closed tappet cavity wall 62. The sides and bottom of the sculpted closed tappet cavity wall 62 are integrally connecting block 20 also between the cavities 60 and along its edges, in addition to being integrally connected at the upper tappet cavity wall 96. Accordingly, the cast wall 62 is sturdy and rigid, minimizing vibration and noise transmission from the moving pushrods, cam followers and other components. Moreover, the sculpted wall 62 provides structural rigidity across the entire side of the block 20, thereby further enhancing the overall stiffness of the block 20. The tappet cavity wall 62 also eliminates the need for a conventional bolt-on cover and associated gasket, reducing a number of engine components.

Due to the enhanced stiffness of the block 20, it has been found that the conventional practice of torque plate honing is unnecessary. Specifically, the cylinder bores 26 do not deflect substantially between free and loaded conditions, thereby eliminating a need for pre-loading the block 20 during machining of the cylinder bores 26. The elimination of this processing step advantageously increases manufacturing efficiency and reduces costs. The stiffened block 20 also maintains its close tolerances, resulting in improved oil consumption performance.

Figure 7:
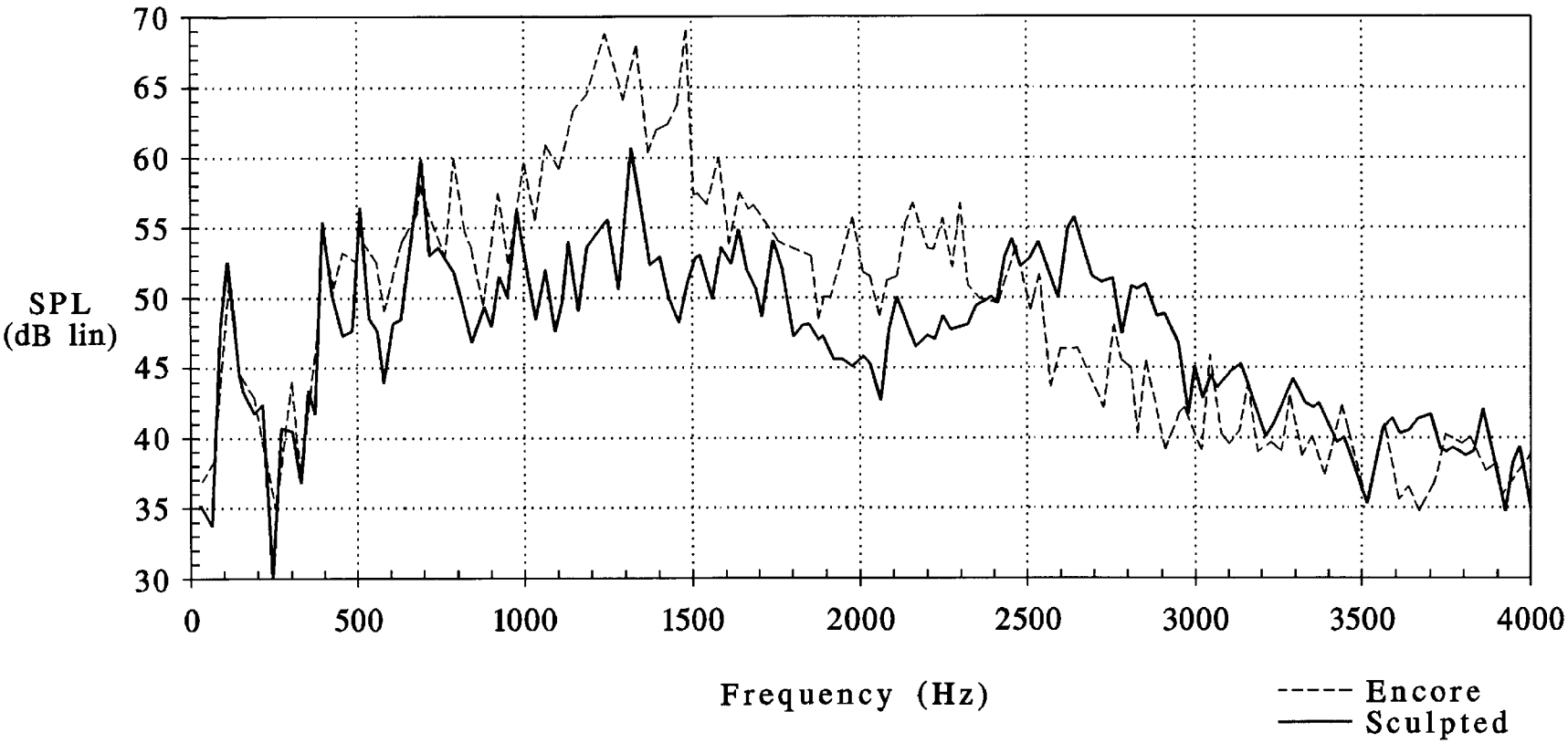
FIG. 7 is a graph showing the noise level as measured on the right side of a cylinder block according to the invention (solid line) and a conventional cylinder block (dashed line).
Figure 8:
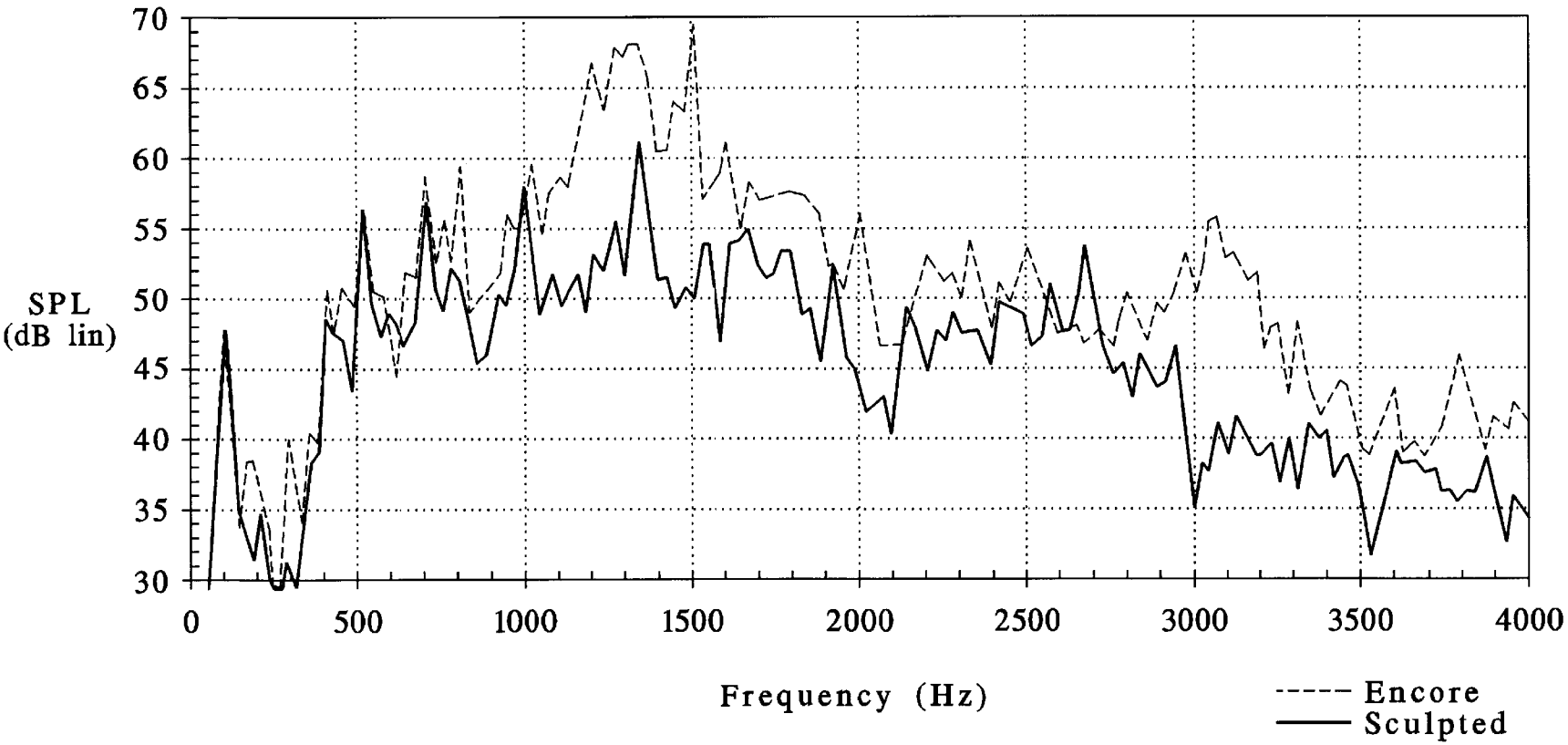
FIG. 8 is a graph showing the noise level as measured on the left side of a cylinder block according to the invention (solid line) and a conventional cylinder block (dashed line).

The above-described features have been found to enhance the stiffness of the block 20, resulting in substantially reduced noise levels. FIGS. 7 and 8 show noise spectrum data as measured from the left and right sides of the cylinder block 20, respectively. In particular, the noise level emitted from the cylinder block of the invention (solid line) is substantially lower than the noise level emitted from a cylinder block having conventional structural features (dashed line). In both FIGS. 7 and 8, the peak noise level of the conventional cylinder block is approximately 69 dB, whereas the peak noise level of the cylinder block 20 of the invention is about 61 dB.

The present invention is not limited to the exemplary embodiments specifically described herein. To the contrary, it is recognized that various changes and modifications to the embodiments specifically described herein would be apparent to those skilled in the art, and that such changes and modifications may be made without departing from the spirit and scope of the present invention. Accordingly, the appended claims are intended to cover such changes and modifications as well.

What is claimed is:

1. A cylinder block comprising an integral metal body having an outer casing, the integral body including an upper portion and a lower portion, the upper portion having a plurality of cylinder bores and the lower portion defining at least a portion of a crankcase, the outer casing including a sculpted wall portion generally at the upper portion of the block and a sculpted wall portion generally at the lower portion of the block, both said upper and lower sculpted wall portions being generally curved in shape and similar in contour.

2. A cylinder block as claimed in claim 1, wherein at least one of said sculpted wall portions includes a series of partially cylindrical sections.

3. A cylinder block as claimed in claim 2, wherein the partially cylindrical sections are located in a vicinity of the cylinder bores and are coaxially oriented therewith.

4. A cylinder block as claimed in claim 1, wherein at least one of said sculpted portions has a generally undulate shape.

5. A cylinder block as claimed in claim 1, further comprising a plurality of ribs, each of the ribs extending between at least one of the cylinder bores and one of said sculpted wall portions.

6. A cylinder block as claimed in claim 5, further comprising a plurality of head bolt bosses having a bolt hole disposed therein, wherein at least one of the head bolt bosses is integrally formed in one of the ribs.

7. A cylinder block as claimed in claim 6, wherein at least one of said ribs is connected to a member disposed between adjacent cylinder bores.

8. A cylinder block as claimed in claim 1, wherein the casing generally encloses a water jacket, the block further comprising:

a plurality of side walls extending from the casing generally defining a cavity shaped to contain an oil cooler;

a water pump outlet disposed in at least one of the side walls to provide a flow of coolant into the cavity; and a cavity wall extending between the side walls generally separating the cavity from the water jacket, an opening formed in the cavity wall to permit fluid communication between the cavity and the water jacket.

9. A cylinder block as claimed in claim 1, wherein at least one of the sculpted portions of the casing encloses a plurality of tappet cavities, each of the cavities generally extending from the crankcase alongside the cylinder bores to the deck to accommodate a plurality of reciprocating pushrods.

10. A cylinder block as claimed in claim 9, further comprising an upper tappet cavity wall integrally formed with the deck and extending across a top edge of the outer tappet cavity wall.

11. The cylinder block as claimed in claim 10, wherein each said tappet cavity includes at least two pushrod holes open to the deck, the upper tappet cavity wall extending between the holes.

12. A cylinder block comprising:

an outer casing generally enclosing a water jacket;

a plurality of side walls extending from the outer casing generally defining a cavity shaped to contain an oil cooler;

a water pump outlet disposed in at least one of the side walls to provide a flow of coolant into the cavity; and a cavity wall extending between the side walls generally separating the cavity from the water jacket, an opening formed in the cavity wall to permit fluid communication between the cavity and the water jacket;

wherein said opening in the cavity wall is generally located at a lower portion of the cavity, and wherein said water pump outlet is distally located relative to the opening, and generally located at an upper portion of the cavity.

13. A cylinder block as claimed in claim 12 further comprising a plurality of bolt bosses formed in said side walls, each of the bosses having a bolthole formed therein to accommodate the securing of a cover plate.

14. A cylinder block comprising:

an upper portion generally including a plurality of cylinder bores, the upper portion having a deck to accommodate the mounting of a cylinder head;

a lower portion integrally extending from the upper portion, the lower portion forming at least a portion of a crankcase, an outer tappet cavity wall integrally formed with the upper portion and lower portion and enclosing a closed tappet cavity, the cavity opening to the crankcase at the lower portion and extending through the upper portion generally alongside the cylinder bores to the deck to accommodate a plurality of reciprocating pushrods, wherein the outer tappet cavity wall has an undulated shape;

an upper tappet cavity wall integrally connected across a top edge of the outer tappet cavity wall at the deck, the upper tappet cavity wall including plurality of pushrod holes opening to the closed tappet cavity and integrally connecting the outer tappet cavity wall to the deck between the holes.

15. A cylinder block as claimed in claim 14 wherein the cylinder block, including the outer tappet cavity wall, is unitarily cast.

* * * * *